US009884491B2

(12) United States Patent
Nacken et al.

(10) Patent No.: US 9,884,491 B2
(45) Date of Patent: Feb. 6, 2018

(54) APPARATUS AND METHOD FOR ASSISTING CHANGE-OVER OF TAKE-UP ROLLS IN A PRINTING SYSTEM

(71) Applicant: Océ-Technologies B.V., Venlo (NL)

(72) Inventors: Peter F. M. Nacken, Venlo (NL); Tom J. H. Clabbers, Venlo (NL); Ronnie E. A. Blom, Venlo (NL); Anne A. Wind, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/292,737

(22) Filed: Oct. 13, 2016

(65) Prior Publication Data

US 2017/0106671 A1 Apr. 20, 2017

(30) Foreign Application Priority Data

Oct. 14, 2015 (EP) ..... 15189770

(51) Int. Cl.
*B41J 2/00* (2006.01)
*B41J 11/00* (2006.01)

(52) U.S. Cl.
CPC ..... *B41J 11/0045* (2013.01)

(58) Field of Classification Search
None
See application file for complete search history.

(56) References Cited

U.S. PATENT DOCUMENTS 3,653,482 A * 4/1972 Cortona ..... B41J 11/54 400/139
5,954,438 A 9/1999 Klein et al.
2013/0100223 A1* 4/2013 Sato ..... G03G 15/652 347/104

FOREIGN PATENT DOCUMENTS

DE 29 12 656 A1 10/1980
EP 1 354 715 A1 10/2003
EP 2 390 103 A1 11/2011

* cited by examiner

*Primary Examiner* — Erica Lin
(74) *Attorney, Agent, or Firm* — Birch, Stewart, Kolasch & Birch, LLP

(57) ABSTRACT

The present invention provides apparatus for assisting change-over of take-up rolls in a printing system, especially in a roll-to-roll printing system. The apparatus comprises a guide device for directing or guiding printed sheet output from the printing system along a transport path towards a take-up roll for winding or taking up a length of the printed sheet, and a first clamping device for holding a new leading edge region of the printed sheet formed after the printed sheet is cut to terminate the length of the sheet to be wound or taken up onto the take-up roll. The first clamping device is configured to hold or clamp the new leading edge region of the printed sheet against movement along the transport path towards the take-up roll. The guide device is movable to redirect the printed sheet output from the printing system to a buffer zone, and the guide device is configured to redirect the printed sheet to the buffer zone when the first clamping device holds or clamps the new leading edge region of the printed sheet. Furthermore, the invention provides a corresponding method of handling take-up rolls in a printing system.

19 Claims, 3 Drawing Sheets

APPARATUS AND METHOD FOR ASSISTING CHANGE-OVER OF TAKE-UP ROLLS IN A PRINTING SYSTEM

FIELD OF THE INVENTION

The present invention relates to an apparatus and method for assisting change-over of take-up rolls for taking up printed sheet in a printing system, especially in a roll-to-roll printing system. The present invention also relates to a printing system that includes such an apparatus for assisting change-over of take-up rolls in order to improve and/or optimize the productivity and work-flow of the system.

BACKGROUND OF THE INVENTION

In printing systems, and especially in roll-to-roll printing systems, in which printed sheet output from the system is gathered by winding the sheet onto a take-up roll, there is always the issue of managing the work-flow from the printing system when the take-up roll is full, i.e. when it reaches its maximum sheet-carrying capacity. At that time, it becomes necessary to replace the full take-up roll at the output end of the printing system, which typically requires a manual intervention by a system operator. The same applies if the take-up roll is to be changed because the current print job has just finished. If the printing continues during the change-over of the take-up roll, the printed sheet may be collected in a buffer zone until the new take-up roll is installed and is ready for taking up (e.g. winding up) the printed sheet. The time required for a manual intervention by an operator to change-over the take-up roll in this regard is typically several minutes. If an excessive amount of time is required by the operator, the printed sheet accumulating in the buffer zone can become creased or damaged. In an extreme case, the printing system must be temporarily interrupted, which has a significant negative impact upon system productivity, as well as on the print quality of the printed sheet after re-starting the printing. It is therefore desirable to improve the speed and efficiency of changing-over take-up rolls in a printing system.

DE2912656 A1 describes a mechanism which feeds endless paper or individual sheets as desired into a typing mechanism, having a roller transporting the inserted paper into the typing position, and feed, guide and transport devices for paper and sheets separately, directing them into a common shaft.

US2013100223 A1 describes a sheet conveyance apparatus comprising a loop forming unit that is disposed on a sheet conveyance path and bends, in a loop, the sheet to be conveyed, and a guide unit that is stepwise high at both sides whereas low at the center, as viewed in a sheet conveyance direction, and extends in the sheet conveyance direction, wherein the sheet sagging in the loop by the loop forming unit enters a guide region being defined between opposite guide faces of paired steps in the stepwise guide unit and having a width according to the width of the sheet, so that the side edges of the sheet abut against the guide faces, thus correcting the skewing of the sheet in the sheet conveyance direction.

SUMMARY OF THE INVENTION

In view of the above, an object of the invention is to provide a new and improved apparatus and method for assisting change-over of take-up rolls in a printing system, and especially in a roll-to-roll printing system, and a printing system which includes such an apparatus.

In accordance with the present invention, an apparatus for assisting change-over of take-up rolls as recited in claim 1 and a method of assisting change-over of take-up rolls as recited in claim 9 are provided. Advantageous and/or preferred features of the invention are recited in the dependent claims.

According to one aspect, therefore, the present invention provides an apparatus for assisting change-over of take-up rolls in a printing system, especially in a roll-to-roll printing system. The apparatus comprises a guide device for directing or guiding a sheet of printed media or substrate output from the printing system along a transport path towards a take-up roll for winding or taking up a length of the printed sheet; and a first clamping device for holding a new leading edge region of the printed sheet formed after the printed sheet is cut to terminate the length of the sheet to be wound or taken up onto the take-up roll. The first clamping device is configured to hold or clamp the new leading edge region of the printed sheet against movement along the transport path towards the take-up roll. Further, the guide device is movable to redirect the printed sheet output from the printing system to a buffer zone, and the guide device is configured to redirect the printed sheet to the buffer zone when the first clamping device holds or clamps the new leading edge region of the printed sheet.

When the take-up roll which is currently winding up or taking up the printed sheet output from the printing system reaches its capacity or is full, and/or when a print job has just been completed, it is typically desirable and/or necessary to change-over the take-up roll. In this regard, the take-up rolls typically comprise roll "cores" formed as tubular or cylindrical rolls comprised of cardboard or plastic or any other suitable material onto which the printed sheet is wound. Accordingly, the invention provides an apparatus which is configured to assist the change-over of the take-up roll, e.g. for terminating a full or finished take-up roll for unloading so that a new take-up roll may be loaded. The first clamping device of the apparatus holds the new leading edge region after the sheet is cut and the guide device automatically redirects the printed sheet output from the printing system to a buffer zone. This leaves the trailing edge of the length of the sheet free to be wound or taken up onto the take-up roll and enables the printing system to continue printing without interruption to the buffer zone while the full or completed take-up roll is replaced. This not only simplifies the procedure for changing over the take-up roll, but also reduces the time required for performing the change-over, and thus improves the productivity and work-flow of the printing system.

In a preferred embodiment, the guide device comprises a guide member which is movable between a first position, in which the printed sheet is directed along the transport path towards the take-up roll, and a second position, in which the printed sheet is redirected to the buffer zone. In a particularly preferred embodiment, the guide member is configured to rotate or to pivot between the first position and the second position. In this way, after a new take-up roll has been installed to replace the full or finished take-up roll, the guide member moves from the second position back to the first position so that the printed sheet is again guided or directed along the transport path to the new take-up roll.

In a preferred embodiment, the first clamping device comprises first clamping members, such as first jaw members, which are movable relative to one another between an open, non-clamping position, for enabling the printed sheet to travel along the transport path towards the take-up roll, and a closed, clamping position for holding or retaining the new leading edge region of the printed sheet. In this regard, the first clamping device may comprise a pair of opposed first clamping members which are configured and arranged to engage the sheet from opposite sides thereof. Each of the first clamping members preferably extends across at least part of a width of the sheet, optionally across substantially a full width of the sheet. The first clamping device is preferably arranged downstream from the guide device along the transport path, i.e. towards the take-up roll.

In a particularly preferred embodiment, the apparatus includes a cutting device for cutting the printed sheet, e.g. transversely or across a width thereof, to define or to terminate the length of the sheet to be wound or taken up onto the take-up roll. The position of the cutting device with respect to the guide device is not especially critical. However, the cutting device is desirably positioned upstream of the first clamping device. This may better enable the first clamping device to clamp and/or hold the new leading edge region of the sheet formed after the cutting device cuts the printed sheet.

In a preferred embodiment, the apparatus comprises a second clamping device located on the transport path downstream of the first clamping device for holding a trailing edge region of the printed sheet formed after the printed sheet is cut; i.e. to finally define or to terminate the length of the sheet to be wound or taken up onto the take-up roll. The second clamping device is configured to hold or clamp the trailing edge region of the sheet against movement along the transport path to the take-up roll. Further, the second clamping device is preferably operable to hold or to retain the trailing edge region of the printed sheet as the take-up roll rotates in order to tension the sheet on the roll. In this way, the second clamping device can be employed to finish or complete the winding of the sheet onto the take-up roll in a taught and compact manner.

Like the first clamping device, the second clamping device preferably comprises second clamping members, such as jaw members, which are movable relative to one another between an open, non-clamping position, for enabling the printed sheet to travel along the transport path towards the take-up roll, and a closed, clamping position for holding or retaining the trailing edge region of the printed sheet. In particular, the second clamping device may comprise a pair of opposed second clamping members which are configured and arranged to engage the sheet from opposite sides thereof. Each of the second clamping members extends across at least part of a width of the sheet, and optionally across substantially a full width of the sheet.

In a preferred embodiment, the apparatus further comprises an attachment device for attaching the trailing edge region of the printed sheet onto the take-up roll to complete the winding or taking up of the sheet prior to discharge or removal of the take-up roll. That is, the attachment device is configured to fix or secure the trailing edge region of the printed sheet at the conclusion of the winding or taking up of the sheet, so that the full or finished take-up roll can be removed or discharged from the take-up position without any unravelling or loosening of the printed sheet. In this way, the apparatus finishes or completes the winding such that the take-up roll is ready to be removed or discharged.

In a preferred embodiment, the apparatus further comprises a control unit which controls movement of one or both of the first clamping device and the guide device and optionally also one or more of the cutting device, the second clamping device, and the attachment device. To this end, the control unit may include one or more sensors for sensing or detecting when a take-up roll is reaching or has reached its capacity or is full and needs to be changed, and/or for sensing or detecting when a print job is nearing completion or is finishing. Further, the control unit is desirably configured to receive and/or to send control signals to control movement of the first clamping device and/or the guide device and optionally also one or more of the second clamping device, the cutting device, and the attachment device based on this information or signals from the one or more sensors.

For example, the control unit may control operation of the cutting device to cut the sheet when the take-up roll is sensed or detected to have reached its capacity or after the print job has finished. The control unit may include a plurality of sensors, including a sensor for sensing or detecting a cut in the sheet created by the cutting device. In this way, after the cut passes through the first clamping members in the open, non-clamping position, the first clamping device may be operated to move the first clamping members to the closed position and thereby clamp and hold the new leading edge portion of the sheet. At the same time or shortly thereafter, the control unit may also control the guide device to redirect the printed sheet output from the printing system to a buffer zone. In this way, the printing (e.g. of the next print job) may continue to the buffer zone. At the same time, the trailing edge region formed by the cut continues along the transport path towards the take-up roll. Upon detection of the cut or trailing edge region nearing the take-up roll, or on a time-basis following activation of the first clamping device, the second clamping device may be activated by the control unit to hold the trailing edge region of the printed sheet to tighten or tension the sheet wound onto the roll. Thereafter, the second clamping device may be opened again and the attachment device may be operated to fix or secure the trailing edge region of the sheet to the finished roll.

According to another aspect, the invention provides a method of assisting change-over of take-up rolls in a printing system, especially in a roll-to-roll printing system, comprising the steps of:

- directing or guiding printed sheet output from the printing system along a transport path towards a take-up roll for winding or taking up a length of the printed sheet,
- cutting the printed sheet to terminate the length of the sheet to be wound or taken up onto the take-up roll, whereby the cutting forms a trailing edge region and a new leading edge region of the printed sheet,
- clamping or holding the new leading edge region of the printed sheet against movement along the transport path towards the take-up roll; and
- redirecting the printed sheet output from the printing system to a buffer zone during said clamping or holding of the new leading edge region.

As discussed above, the invention is configured to assist the change-over, i.e. the unloading and then loading, of take-up rolls for taking up the printed sheet output in a printing system. In this way, the manual intervention required from an operator can be reduced to simplify the procedure and improve the productivity and work-flow of the printing system.

In a preferred embodiment, the step of directing or guiding the sheet along the transport path is via a guide member, and the step of redirecting the printed sheet to the buffer zone comprises moving, and especially rotating or pivoting, the guide member from a first position, in which the sheet is guided along the transport path towards the take-up roll, to a second position, in which the sheet is redirected to the buffer zone.

In a preferred embodiment, the method further comprises the step of: clamping or holding the trailing edge region of the printed sheet against movement on the transport path towards the take-up roll in order to tension the sheet wound onto or taken up onto the take-up roll.

In a preferred embodiment, the method further comprises the step of: attaching the trailing edge region of the printed sheet onto the take-up roll to complete winding or taking up the printed sheet prior to discharge or removal of the take-up roll.

In a preferred embodiment, the method further comprises the step of: controlling operation of a first clamping device for clamping or holding the new leading edge region of the printed sheet against movement along the transport path; and/or controlling operation of a guide device for redirecting the printed sheet output from the printing system to the buffer zone during said clamping or holding of the new leading edge region.

In a preferred embodiment, the method further comprises the step of: controlling operation of a second clamping device for clamping or holding the trailing edge region of the printed sheet against movement along the transport path; and/or controlling operation of an attachment device for attaching the trailing edge region of the printed sheet onto the take-up roll to complete winding or taking up the printed sheet prior to discharge or removal of the take-up roll.

According to a further aspect, the present invention provides a printing system comprising an apparatus for assisting change-over of take-up rolls for taking up printed sheet according to any one of the embodiments described above, and/or for performing a method of assisting change-over of take-up rolls for taking up printed sheet according to any one of the embodiments described above.

In a preferred embodiment, the printing system further comprises a guide device for guiding printed sheet towards or onto a take-up roll in the printing system. The guide device comprises a first guide member presenting a substantially planar surface for limiting or preventing lateral deviation of printed sheet output from the printing system as the sheet travels along a transport path towards the take-up roll for winding or taking up a length of the printed sheet. A position of the first guide member is adjustable in a direction transverse to the transport path, and typically generally parallel to a plane of the sheet, for setting the position to limit or prevent lateral deviation of a printed sheet along a transport path.

In this way, the guide device does away with the need for rotating flanges mounted on the core of the take-up roll or receiving roll which only work with a print medium or sheet having the same width as the core. Instead, the guide device in this embodiment is deployed independently of the core (upstream of the take-up roll on the transport path) and is adjustable to accommodate medium or sheet having different sizes or widths. This, in turn, makes it possible to use print medium, such as sheet, that is narrower in width than a particular take-up roll core length. The guide device is then simply able to be adjusted to a suitable position or width to suit the print medium (i.e. sheet) that is currently in use in the printing system. Overall, this provides for a less cumbersome and more flexible printing system.

Thus, in a typical embodiment of the guide device, the first guide member (and, indeed, the entire guide device) is fixed or stationary in use and the position of the first guide member is adjustable along an axis in a direction transverse to the transport path and roughly parallel to a plane of the sheet. Accordingly, the stationary first guide member can be positioned on the transport path upstream and independently of the take-up roll core to limit or prevent lateral deviation of a printed sheet along the transport path.

In a preferred embodiment, the first guide member is configured—for example, via attachment means—to be mounted on a shaft or rod for adjustment of its position along the axis transverse to the transport path. In this regard, the axis is preferably a longitudinal axis of the shaft or rod and the first guide member may be slidable along the shaft or rod in the axial direction; e.g. via the attachment means. The attachment means is naturally configured to fix or lock the position of the first guide member once an appropriate or desired position has been selected or reached. Preferably, the first guide member with the substantially planar surface comprises a flange member. In this context, the attachment means may include an opening or aperture in the first guide member or flange member for receiving the shaft or rod upon which the first guide member is mounted. The opening or aperture may be configured to interact or inter-engage with the shaft or rod to exclude a rotation of the first guide member about the longitudinal axis of the shaft or rod.

In a particularly preferred embodiment, the guide device comprises a pair of first guide members. A position of each of the first guide members is adjustable along an axis in a direction transverse to the transport path, and typically generally parallel to a plane of the sheet, to limit or to prevent lateral deviation of the sheet between the respective planar surfaces as the sheet travels along the transport path towards the take-up roll.

In a preferred embodiment, the guide device further comprises a second guide member presenting a support surface for support the printed sheet thereon and directing or guiding the sheet along the transport path towards the take-up roll. To this end, the support surface of the second guide member may be comprised of a low friction material or have a low friction coating to promote easy passage of the sheet along the transport path. In a particularly preferred form, the support surface of the second guide member is curved and is arranged to direct or guide the printed sheet from a buffer zone of the printing system towards the take-up roll. In this regard, the printing system will typically include a buffer zone to accommodate printed medium or sheet when a take-up roll is being changed over. That is, when a take-up roll is full (i.e. when it reaches its maximum sheet-carrying capacity), it becomes necessary to replace the full roll at an output end of the printing system. During the change-over, the printing system may continue the printing operation by redirecting printed medium or sheet output from the system to the buffer zone until the new take-up roll is ready to receive the printed medium. The printed medium or sheet which collects or accumulates temporarily in one or more loose folds in the buffer zone is known as a "blouse". Once the new take-up roll core is ready to wind up the folds of printed medium or sheet ("blouse") from the buffer zone, the curved surface of the second guide member is configured and arranged to direct or guide the sheet from the buffer zone through a curve defined by the curved surface towards the take-up roll.

In a preferred embodiment, the first guide member and the second guide member are integrally formed as a guide unit in the guide device. The guide device may include a pair of guide units, with the position of each guide unit being adjustable along the axis in the direction transverse to the transport path.

Thus, the guide device in the printing system is configured to provide accurate winding of printed sheet without any significant tension in the sheet (i.e. relatively slack printed sheet at the output of the printing system and/or in the blouse) which nevertheless produces quite a tightly would and compact take-up roll when wound with the sheet. The guide device also provides for efficient and easy leading edge attachment to a new receiving roll or take-up roll core, as no flanges are required on the core and the core may be wider than the printed medium of sheet. Because there is no need for flanges on the ends of the take-up roll core, this also assists uninterrupted printing and unattended winding, especially after a cut in a roll-to-roll printing system.

In a preferred embodiment, the printing system further comprises an apparatus for handling take-up rolls, and especially for loading and unloading take-up rolls, in a printing system, such as a roll-to-roll printing system. The apparatus for handling take-up rolls comprises a holder device for holding a take-up roll in a take-up position, wherein the take-up roll is rotatable about a longitudinal axis thereof in the take-up position for taking-up printed sheet output from the printing system. The holder device is movable to release or discharge the take-up roll from the holder device when the take-up roll is full or when a print job is finished, wherein a movement of the holder device to release or discharge a full take-up roll operates to load or to receive a new take-up roll onto the holder device and into the take-up position.

In this way, the printing system includes an apparatus for handling take-up rolls which is configured for loading and unloading take-up rolls to and from the take-up position automatically. In other words, the need for a manual intervention from an operator may be reduced to a minimum. This not only simplifies the procedure for changing over the take-up roll, but also significantly reduces the time required for performing the change-over, and this necessarily makes a substantial contribution to improving the productivity and work-flow of the printing system. Furthermore, the fact that the new take-up roll which is loaded onto the holder device is loaded directly into the take-up position to replace the full take-up roll that has just been released or discharged provides for very high efficiency in handling of the take-up rolls by the take-up roll handling apparatus.

In a preferred embodiment, the holder device is rotatable to release or discharge the take-up roll from the holder device when the take-up roll is full or when a print job is finished. Thus, a rotation of the holder device to release or discharge a full take-up roll also operates to load a new take-up roll onto the holder device and into the take-up position. In other words, the holder device comprises a rotatable holder member which supports or holds the take-up roll in the take-up position, and rotation of the holder member effects both unloading of the full take-up roll as well as loading of the new take-up roll.

In a preferred embodiment, the holder device, and especially the rotatable holder member, comprises a plurality of holding portions, each of which is configured to receive and support a take-up roll. Each of the holding portions is respectively movable, e.g. rotatable, from a loading position (i.e. at which the take-up roll is loaded or received onto the holder device) to the take-up position, and from the take-up position to a release position (i.e. at which the take-up roll is released or discharged from the holder device).

In a particularly preferred embodiment, therefore, the holder device includes a first holding portion and a second holding portion. The first and second holding portions are configured to move simultaneously with one another and, when the first holding portion moves from the take-up position to the release position to release or eject a full take-up roll from the holder device, the second holding portion moves from the loading position to the take-up position to load or receive a new take-up roll onto the holder device. In this way, a single (e.g. rotary) movement of the holder device, and especially the rotatable holder member, performs both the unloading of one take-up roll and the loading of the new take-up roll. This provides a very direct and efficient manner of handling the take-up rolls, which also assists the optimization of the printing system.

In a further particularly preferred embodiment, the holder device includes a third holding portion configured to move simultaneously with the first and second holding portions. The third holding portion is positioned and arranged such that, when the first holding portion moves from the take-up position to the release position in order to release or discharge a full take-up roll from the holder device, the third holding portion moves from the release position to the loading position. In this way, the third holding portion may provide an intermediate holding portion that moves to replace the second holding portion functionally in the loading position, as or when the second holding portion moves to the take-up position.

Each holding portion of the holder device (e.g. of the holder member) may include a pair of fingers or prongs between which a take-up roll is received and supported, e.g. in the take-up position. Furthermore, each holding portion preferably includes a support surface which either substantially conforms with, or follows a profile of, an outer surface of the take-up roll.

In a preferred embodiment, the take-up roll handling apparatus further comprises a roll supply, which may be in the form of a hopper, for storing a plurality of take-up rolls for taking-up printed sheet. In this regard, the take-up rolls are typically in the form of roll "cores" onto which the printed sheet may be wound. The take-up rolls or roll "cores" are typically tubular or cylindrical rolls and may be comprised of cardboard or plastic or any other suitable material. The roll supply is configured to deliver each of the rolls stored in the supply individually to the holder device at the loading position, preferably via a gravity-feed configuration.

In a preferred embodiment, the take-up roll handling apparatus further comprises a collector unit for collecting the take-up rolls released or discharged from the holder device. In this regard, the collector unit is desirably configured to store the take-up rolls in a sequence corresponding to an order or chronology of their release or discharge from the holder device. In this way, the collector unit enables an operator to easily correlate the discharged take-up rolls held within the collector unit to one or more particular printing jobs.

In a preferred embodiment, the printing system comprises a control unit which controls movement of the holder device in the take-up roll handling apparatus. In particular, the control unit may include a sensor for sensing or detecting when a take-up roll has reached capacity or is full and needs to be changed. Further, the control unit may also include a sensor for sensing or detecting when a print job is finished and be configured to receive and/or send control signals to control movement of the holder device based on this information. By controlling operation or movement of the holder device to unload—i.e. to release or discharge—a full take-up roll, the take-up roll handling apparatus automatically operates to load a new take-up roll from the roll supply.

By combining a guide device for guiding printed sheet towards or onto a take-up roll with an apparatus for assisting change-over of take-up rolls and an apparatus for handling take-up rolls (e.g. for loading and unloading take-up rolls) in a printing system, a particularly convenient and effective arrangement for attaching (e.g. via tape) a leading edge of a print medium or sheet to the take-up roll core is provided while maintaining printing and without disrupting the printed sheet and providing a time frame to do so.

The buffer zone or "blouse" effectively decouples the sheet from forces acting on it by introducing additional degrees of freedom in the sheet. Pulling or tension forces may originate from the take-up roller, but are minimized on the sheet under the print head, since the blouse removes the tension in the sheet. Thus, pulling on the sheet by the take-up roller does not affect print quality. This also allows for easy alignment of the sheet on the take-up roll. The (e.g. S-shaped) curve of the sheet in the blouse allows movement of the leading edge with respect the part of the sheet upstream of the blouse. Again, this is due to additional degrees of freedom. This freedom allows the operator to attach the leading edge to the take-up roll core with little force.

Damage to the sheet on the guide device is prevented, since the blouse removes lateral forces and tension in the sheet. If there were tension, the curved second guide member might cut into the edge of the sheet. Also, as the sheet passes over the curved second guide member, it becomes locally stiffer and the likelihood of buckling is reduced. The additional curves of the S-shaped blouse enhance local stiffness of the sheet compared to a C-shaped blouse.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference characters designate like parts and in which.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

DETAILED DESCRIPTION OF EMBODIMENTS

Figure 1:
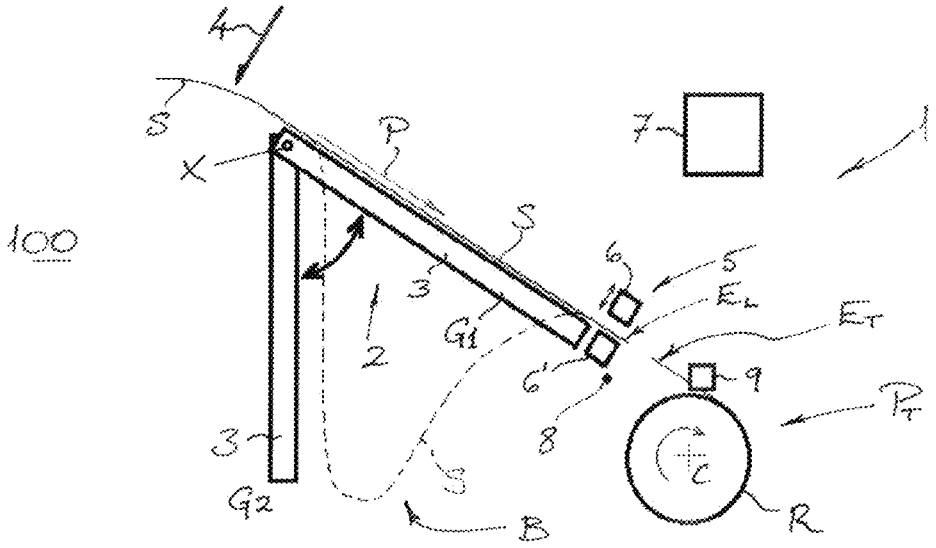
FIG. 1 is a schematic side view of an apparatus for assisting change-over of take-up rolls in a printing system according to one embodiment of the invention.

With reference firstly to FIG. 1 of the drawings, one embodiment of an apparatus 1 for assisting change-over of take-up rolls R in a printing system 100 is illustrated schematically. The apparatus 1 includes a guide device 2 comprising a panel-like guide member 3 for directing or guiding a sheet S of printed media which is output from the printing system 100 along a transport path P towards a take-up roll R for winding or taking up a length of the printed sheet S. The take-up roll R typically comprises a tubular or cylindrical roll "core" formed of cardboard or plastic or any other suitable material, which is mounted in a take-up position $P_T$ in the printing system 100 and is driven in rotation about its central longitudinal axis C for winding or taking up the printed sheet S on the roll R. Thus, the printed sheet S which is output from the printing system 100 via the apparatus 1 moves along the transport path P by virtue of both "pushing" forces imparted to the sheet S by feed rollers (not shown) as well as "pulling" forces imparted to the sheet S, for example, by the driven take-up roll R.

The apparatus 1 further includes a cutting device 4, such as a knife or a blade, for cutting the printed sheet S transversely across a width thereof to terminate or to define a length of the sheet S to be wound or taken up onto the take-up roll R. In particular, when the take-up roll R is detected to have reached its capacity or when the print job is detected as having finished, the cutting device 4 is controlled and operated to cut the sheet S to end the length of that printed sheet S to be wound onto the current take-up roll R. The step of cutting the continuous sheet S in this way therefore forms a trailing edge region $E_T$ and a new leading edge region $E_L$ of the printed sheet S. Under the influence of both the "pushing" forces and "pulling" forces imparted to the sheet S, both the trailing edge region $E_T$ and new leading edge region $E_L$ of the printed sheet S continue to travel along the transport path P downstream of the cutter device 4 towards the take-up roll R.

Referring still to drawing FIG. 1, the apparatus 1 includes a first clamping device 5 having a pair of opposed first clamping members or first jaw members 6, 6' which are movable relative to one another between an open position (shown) to allow the sheet S to travel along the transport path P towards the take-up roll R, and a closed position to clamp and hold the new leading edge region $E_L$ of the sheet S. In particular, the first clamping device 3 is configured to hold the new leading edge region $E_L$ of the printed sheet S against movement along the transport path P towards the take-up roll R. The guide device 2 is configured to cooperate closely with the first clamping device 5 in this regard. Specifically, the panel-like guide member 3 which extends beneath the printed sheet S and directs the sheet S along the transport path P to the take-up roll is mounted for pivoting movement about a hinge axis X between a first position $G_1$ and a second position $G_2$. In this way, when the jaw members 6, 6' of the first clamping device 5 close to hold the new leading edge region $E_L$ of the sheet S, the guide panel 3 can be moved or pivoted to redirect the printed sheet S output from the system 100 to a buffer zone B, where the sheet S then collects or accumulates temporarily in one or more loose folds (known as a "blouse"), as shown in broken lines.

The guide device 2 and the first clamping device 5 are operated by a control unit or controller 7 which typically includes a processor and one or more sensors 8. After the knife or blade of the cutting device 4 cuts the sheet S, both the trailing edge region $E_T$ and new leading edge region $E_L$ at the cut continue to move along the transport path P towards the take-up roll R. A sensor 8, such as an optical sensor, positioned on or adjacent to the first clamping device 5 may be configured to detect the new leading edge region $E_L$ of the sheet S. Upon detection of the cut or the leading edge region $E_L$ within, or just downstream of, the jaw members 6, 6', the controller 7 may activate the first clamping device 5 to close and thereby clamp and hold the leading edge region $E_L$ and then also to move the panel member 3 of the guide device 2 to the second position $G_2$ to redirect the sheet S emerging from printing heads or from a drying and fixing portion of the printing system 100 to the buffer zone B. At the same time, the take-up roll R is still driven in rotation about the axis C to wind up the final portion of the printed sheet S having the trailing edge region $E_T$ formed by the cut. An attachment device 9 is provided adjacent the take-up roll R to fix or secure the trailing edge region $E_T$ of the sheet S to the roll. In this way, the finished or fully-wound take-up roll R is then ready to be removed or discharged from the take-up position $P_T$ and replaced by a new take-up roll R. This may be performed manually by an operator intervention and/or automatically. After the new take-up roll R is mounted in the take-up position $P_T$, the new leading edge region $E_L$ of the sheet S can be released from the first clamping device 5 and the sheet S fed or drawn out from the buffer zone B to be wound onto the new take-up roll R. Once the buffered portion of the sheet is taken up on the roll R, the guide panel 3 is operated to be pivoted back into the first position $G_1$ to guide the printed sheet S along the transport path P towards the take-up roll R as before.

Figure 2:
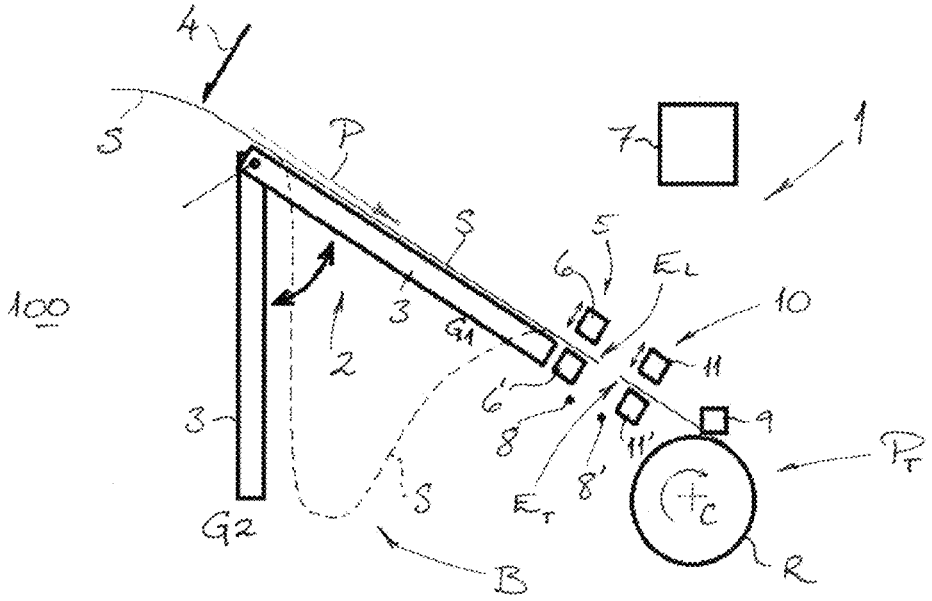
FIG. 2 is a schematic side view of an apparatus for assisting change-over of take-up rolls in a printing system according to another embodiment of the invention.

With reference to FIG. 2 of the drawings, another embodiment of the apparatus 1 of the invention is illustrated. In addition to all of the features described above with respect to FIG. 1, this embodiment includes a second clamping device 10 having a pair of opposed second clamping members or second jaw members 11, 11' which are movable relative to one another between an open position (shown) to allow the sheet S to travel further along the transport path P onto the take-up roll R, and a closed position for holding the trailing edge region $E_T$ of the sheet S. In particular, the second clamping device 10 is configured to hold the trailing edge region $E_T$ of the printed sheet S against movement while the take-up roll R continues to be driven in rotation to apply tension to the sheet and draw the roll R taught as the winding or taking up of the printed sheet S is completed immediately prior to the attachment device 9 securing the free trailing edge region $E_T$ to the roll R. In this way, as the first clamping device 5 grips and holds the new leading edge $E_L$ of the sheet S and the guide device 2 is controlled to redirect the emerging printed sheet to the buffer zone B, the second clamping device 10 is activated by the controller 7 when a sensor 8' (such as optical sensor) provided on or adjacent to the second clamping device 10 detects the trailing edge region $E_T$ of the sheet S approaching the take-up roll R, e.g. within or adjacent to the second jaw members 11, 11'. The second clamping device 10 may thus cooperate with the attachment device 9 to ensure that the take-up roll R is wound and completed as a taught and compact and secure package of printed sheet S from the printing system 100 ready to be removed or discharged from the take-up position $P_T$ and replaced with a new take-up roll R.

Figure 3:
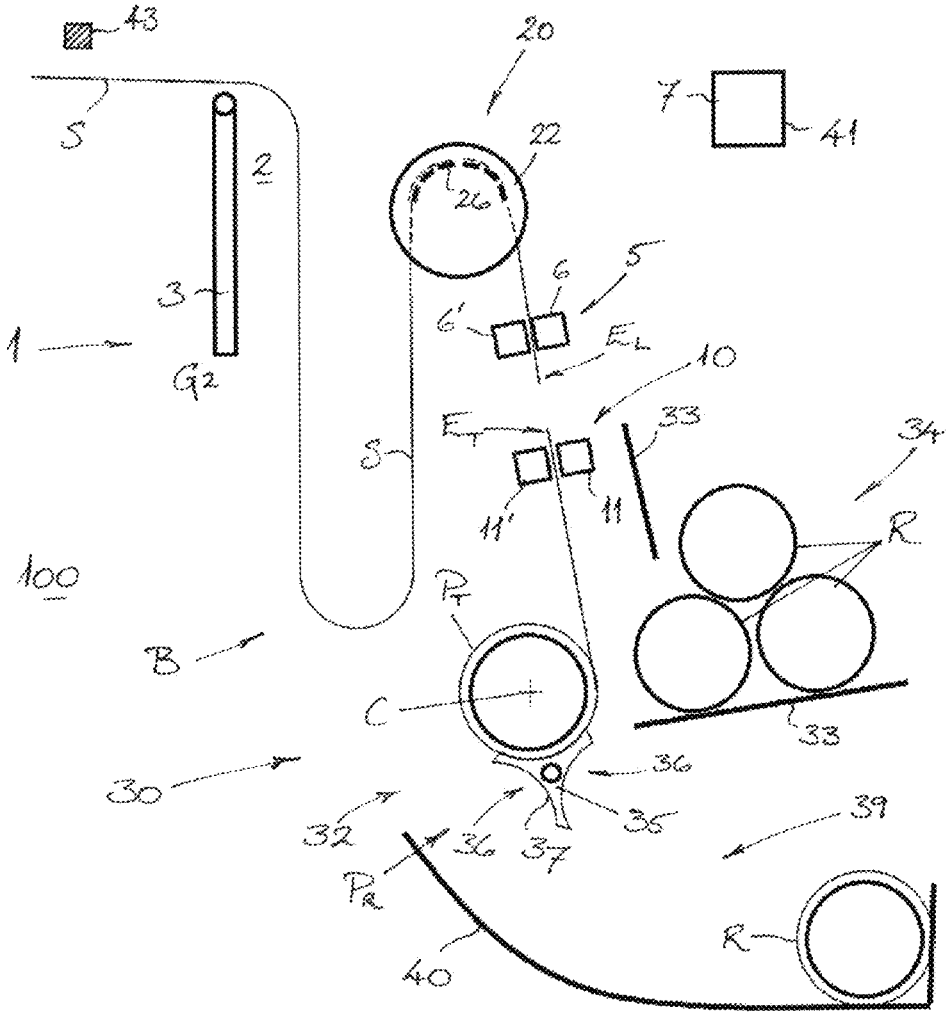
FIG. 3 is a schematic side view of an output end region of a printing system according to an embodiment of the invention including an apparatus for assisting change-over of take-up rolls according to the invention, a guide device for guiding printed medium or sheet to a take-up roll, and an apparatus for handling the take-up rolls.

With reference now to FIG. 3 of the drawings, a printing system 100 according to a preferred embodiment and comprising an apparatus 1 for assisting change-over of take-up rolls R for taking up printed sheet S according to the embodiment of FIG. 2 described above is illustrated. The printing system 100 of this embodiment further comprises a guide device 20 for guiding the printed sheet S towards the take-up roll R in the printing system, and an apparatus 30 for handling the take-up rolls R, and especially for loading and unloading the take-up rolls R in the system 100. As the apparatus 1 for assisting the change-over of the take-up rolls R is essentially as described in detail above with reference to FIG. 2, this part of the system 100 shown in FIG. 3 will not be described again in detail. The guide device 20 and the take-up roll handling or loading/unloading apparatus 30, however, are described in detail with reference also to FIGS. 4 and 5 of the drawings.

Figure 5:
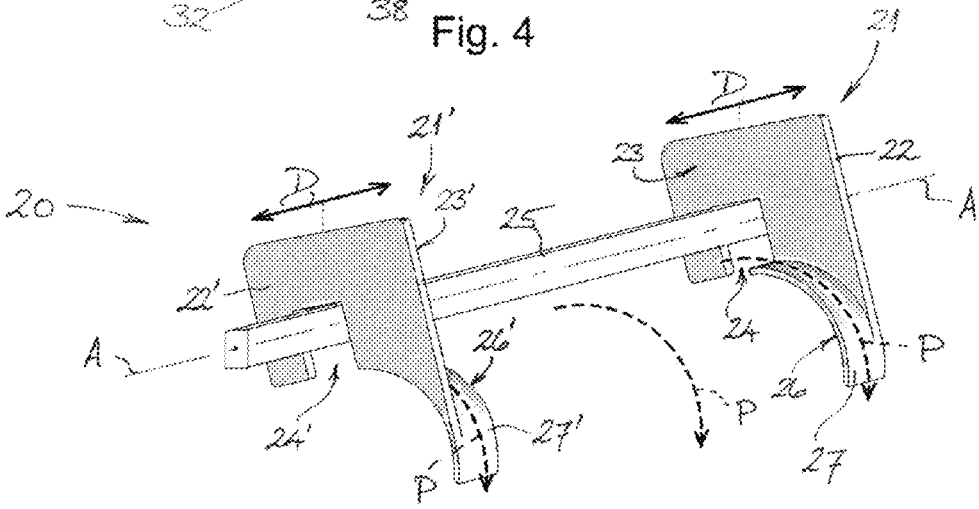
FIG. 5 is a schematic perspective view of the guide device for guiding the printed medium or sheet onto the take-up roll in the printing system shown in FIG. 3.

Thus, referring to FIGS. 3 and 5, a preferred embodiment of a guide device 20 for guiding the print medium, e.g. printed sheet S, towards the receiving roll or take-up roll R in the printing system 100 is particularly suitable for wide format roll-to-roll inkjet printing systems which generally employ print medium sheet or substrate having a width in the range of about 1 meter to about 4 meters, and more typically in the range of about 1.8 meters to 3.2 meters. As noted earlier, the take-up roll R typically comprises a tubular or cylindrical roll "core" formed of cardboard or plastic or other suitable material, which is mounted in a take-up position $P_T$ in the printing system 100 and is driven in rotation about its central longitudinal axis for winding or taking up the printed sheet S on the roll. Thus, the printed sheet S output from the printing system 100 via the guide device 10 is moved along the transport path P by virtue of "pushing" forces imparted to the sheet S by feed rollers (not shown) as well as "pulling" forces imparted to the sheet S by the driven take-up roll R.

In this embodiment, the guide device 20 comprises a pair of guide units 21, 21' and each guide unit 21, 21' includes a generally flat first guide member 22, 22' (e.g. circular or rectangular) which presents a substantially planar surface 23, 23' for limiting or preventing lateral deviation of the sheet S output from the printing system 100 as the sheet travels along the transport path P to the take-up roll R for winding or taking up a length of the sheet. A position of the first guide member 22, 22' is adjustable in a direction D transverse to transport path P, and the position is able to be set to limit or prevent lateral deviation of the sheet S as it travels on the transport path P. In this regard, the first guide member or flange 22, 22' includes an opening or aperture 24, 24' which forms an attachment means via which the guide unit 21, 21' is mounted on a shaft or rod 25 for adjustment of the position along an axis A in the direction D transverse to the transport path P. The axis A is typically a longitudinal axis of the shaft or rod 25 and each first guide member 22, 22' may be able to be positioned along the shaft or rod 25 in the axial direction via its opening or aperture 24, 24'. After a position of each first guide member 22, 22' (i.e. of the guide device 20) has been adjusted and set for a particular sheet width, the first guide members 22, 22' remain fixed or stationary in use.

Each of the guide units 21, 21' of the guide device 20 in the embodiment of FIGS. 3 and 5 further includes a second guide member 26, 26' presenting a curved support surface 27, 27' for directing or guiding sheet S along the transport path P towards the take-up roll R. That is, the curved support surface 27, 27' of the second guide members 26, 26' is configured and arranged to support the printed sheet thereon as the sheet S travels along the transport path P towards the take-up roll. To this end, the support surface 27, 27' of each second guide member 26, 26' is desirably at least partially circularly or elliptically curved. It preferably also has low friction properties to promote easy passage of the sheet S on the transport path P. In this way, support surfaces 27, 27' of the second guide members 26, 26' are configured and arranged to direct or guide the printed sheet S from the buffer zone B of the printing system 100 towards the take-up roll R. Thus, during a change-over of the take-up roll R, the printing system 100 may continue printing by redirecting printed sheet S to the buffer zone B until a new take-up roll R is ready to receive the sheet. The sheet collects or accumulates temporarily in one or more loose (e.g. S-shaped) folds in the buffer zone (i.e. as a "blouse"). When a new take-up roll core is ready to wind up the folds of printed sheet or "blouse" from the buffer zone B, the curved support surfaces 27, 27' of the second guide members 26, 26' are designed to direct or guide the sheet S from the buffer zone B through a curve in the transport path P defined by the curved surfaces 27, 27' towards the new take-up roll R. As is apparent from FIG. 5, the first guide members or flange members 22, 22' and the curved second guide members 26, 26' are integrally formed in the respective guide unit 21, 21' in this embodiment of the guide device 20.

Figure 4:
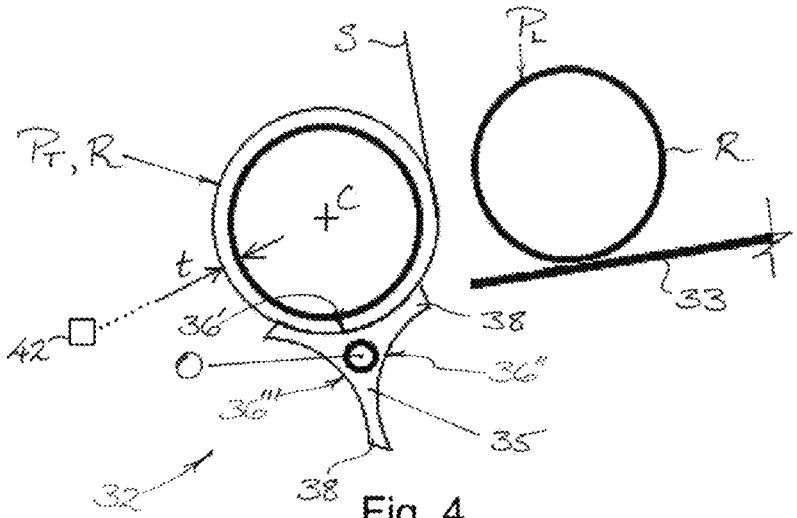
FIG. 4 is a detailed side view of part of the apparatus for handling the take-up rolls in the printing system shown in FIG. 3.

With reference now to FIGS. 3 and 4 of the drawings, an apparatus 30 for handling (i.e. loading and unloading) the take-up rolls R in the printing system 100 is shown schematically. The apparatus 30 includes a holder device 32 mounted on a frame 33 of the apparatus 30 for holding a take-up roll R in a take-up position $P_T$, such that the take-up roll R is able to rotate about its central longitudinal axis C in the take-up position $P_T$ for taking-up printed sheet S output from the printing system 100. In this regard, the take-up roll R comprises a tubular or cylindrical roll core typically made of cardboard or plastic which is driven in the take-up position $P_T$ to rotate about its central axis C in order to wind up the printed sheet S as it emerges from the printing heads or from a drying and fixing portion of the system 100. As can be seen in FIG. 3, the apparatus 30 comprises a roll supply 34 for storing a plurality of take-up rolls R, each of which is provided as a tubular or cylindrical roll core typically made of cardboard or plastic. The roll supply 34 is in the form of a hopper mounted on the frame 33 of the apparatus 30 and is configured to guide or feed each of the rolls R individually, preferably under gravity, to a loading position $P_L$ at or adjacent to the holder device 32.

With reference now also to FIG. 4 of the drawings, the holder device 32 comprises a holder member 35 which is rotatable about an axis O of rotation (i.e. parallel to axis C of the take-up roll R in the take-up position $P_T$) and includes three separate holding portions 36, namely a first holding portion 36', second holding portion 36", and third holding portion 36'''. These holding portions 36 are spaced around the holder member 35 and each is configured to receive and support a take-up roll R thereon. In this regard, each of the holding portions 36 has a respective support surface 37 that generally follows a contour of an outer surface of the take-up roll R supported thereon. Furthermore, each holding portion 36 extends between or includes prong- or finger-like ends or protrusions 38. The first, second and third holding portions 36', 36", 36''' are preferably formed integrally as part of the holder member 35 and are thus configured to move simultaneously with one another.

The holder device 32 is configured so that it is rotatable to release or to discharge the take-up roll R from its position on the holder device 32 when the take-up roll R is full or when a print job is finished. In this regard, rotation of the holder device 32 to release or discharge the full take-up roll R also operates to load a new take-up roll R onto the holder device 32 and into the take-up position $P_T$. More particularly, when the holder member 35 rotates about the axis O, the first holding portion 36' then moves from the take-up position $P_T$ to the release position $P_R$ to release or eject the full take-up roll R from the holder device 32 to a collector unit 39. The collector unit 39 is designed to collect the full take-up rolls R that are released or discharged from the holder device 32. In this regard, the collector unit 39 may be configured to receive the full take-up rolls R gently via a gradually sloping guide path 40, which stores the take-up rolls R in a sequence corresponding to the order of their release from the holder device 32.

When first holding portion 36' moves from the take-up position $P_T$ to the release position $P_R$ during rotation of the holder member 35 about the axis O, the second holding portion 36" moves from the loading position $P_L$ to the take-up position $P_T$ and thereby loads or receives a new take-up roll R from the supply 34 onto the holder device 32. As will be apparent from the drawings, when the first holding portion 36' of the holder member 35 rotates from the take-up position $P_T$ to the release position $P_R$ to release or discharge the full take-up roll R from the holder device 32, the third holding portion 36''' of the holder member 35 rotates from the release position $P_R$ to the loading position $P_L$ to be position ready for the next take-up roll loading operation.

The apparatus 30 further includes a control unit 41 (which may be combined or integrated with control unit 7 of apparatus 1) to control the movement of the holder device 32. In particular, the control unit 41 includes a sensor 42 for sensing or detecting when a take-up roll R has reached capacity or is full and needs to be changed. In this regard, the sensor 42 may detect the amount of printed sheet S already wound onto the take-up roll in the take-up position $P_T$; for example, via a thickness t of the wound amount of the sheet S. Alternatively, or in addition, the control unit 41 may include a sensor 43 for detecting or registering when a print job is finished. In any case, the control unit 41 is configured to send control signals to control movement of the holder device 32 based on the data or information provided by sensors 42, 43. By controlling the movement of the holder device 32 in this way to unload—i.e. to release or discharge—a full take-up roll R, the take-up roll handling apparatus 30 then automatically operates to load or to receive a new take-up roll R form the roll supply 34 onto the holder device 32 and directly into the take-up position $P_T$.

Figure 6:
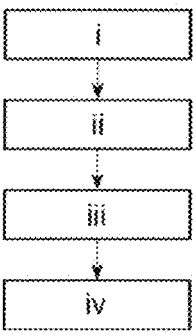
FIG. 6 is a flow diagram which schematically illustrates a method according to a preferred embodiment of the invention.

Finally, referring to FIG. 6 of the drawings, a flow diagram is shown that illustrates schematically the steps in a method of assisting a change-over of take-up rolls R in a printing system 100 according to the embodiments of the invention described above with respect to drawing FIGS. 1 and 2. In this regard, the first box i of FIG. 6 represents the step of directing or guiding printed sheet S output from the printing system 100 along the transport path P towards the take-up roll R mounted in the take-up position $P_T$ for winding or taking up a length of the printed sheet S. The second box ii represents the step of cutting the printed sheet S to terminate the length of the sheet S to be wound or taken up onto the take-up roll R, whereby the cutting forms a trailing edge region $E_T$ of the sheet S and a new leading edge region $E_L$ of the printed sheet S emerging or output from the printing system 100. The third box iii then represents the step of clamping or holding the new leading edge region $E_L$ of the printed sheet S against movement along the transport path P towards the take-up roll R. The final box iv in drawing FIG. 6 then represents the step of redirecting the printed sheet S output from the printing system 100 to a buffer zone B during the clamping or holding of the new leading edge region $E_L$ which stops the sheet S upstream of the cut from progressing to the take-up roll R. The method of the invention therefore assists the finishing of the take-up roll R for change-over with low operator effort or intervention. This enables the installation and preparation of the new take-up roll R to occur quickly, which in turn improves the productivity and work-flow of the printing system 100.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

LIST OF REFERENCE SIGNS

1 apparatus
2 guide device
3 guide member or panel member
4 cutting device
5 first clamping device
6 first clamping member
6' first clamping member
7 control unit or controller
8 sensor
8' sensor
9 attachment device
10 second clamping device
11 second clamping member
11' second clamping member
20 guide device
21 guide unit
21' guide unit
22 first guide member or flange member
22' first guide member or flange member
23 substantially planar surface
23' substantially planar surface
24 opening or aperture
24' opening or aperture
25 shaft or rod
26 second guide member
26' second guide member
27 support surface
27' support surface
30 take-up roll handling apparatus
32 holder device
33 frame
34 roll supply
35 holder member
36 holding portion
36' first holding portion
36" second holding portion
36'" third holding portion
37 support surface
38 finger or prong
39 collector unit
40 guide path of collector unit
41 control unit
42 sensor
43 sensor
100 printing system
P transport path
S printed sheet
R take-up roll or roll core
$P_T$ take-up position
$P_R$ release position
$P_L$ load position
C central or rotational axis of take-up roll
B buffer zone
X pivot axis of guide member
$G_1$ first position of the guide member
$G_2$ second position of the guide member
D adjustment direction
A adjustment axis of guide device
O rotational axis of holder device
t thickness

The invention claimed is:

1. An apparatus for assisting replacement of a take-up roll for winding or taking up a length of a printed sheet with a new take-up roll in a printing system, comprising:

a guide device for directing or guiding a printed sheet output from the printing system along a transport path towards the take-up roll for winding or taking up a length of the printed sheet in a take-up position; and a first clamping device for holding a new leading edge region of the printed sheet formed after the printed sheet is cut to terminate the length of the sheet to be wound or taken up onto the take-up roll, wherein the first clamping device is configured to hold or clamp the new leading edge region of the printed sheet against movement along the transport path towards the take-up roll in the take-up position;

wherein the guide device is movable to redirect the printed sheet output from the printing system to a buffer zone to accommodate the printed sheet when the take-up roll in the take-up position is being replaced, and wherein the guide device is configured to redirect the printed sheet to the buffer zone when the first clamping device holds or clamps the new leading edge region of the printed sheet, and wherein the new leading edge region of the printed sheet is released from the first clamping device and the printed sheet is fed or drawn out from the buffer zone to be wound onto the new take-up roll after the new take-up roll is mounted in the take-up position to replace the take-up roll.

2. The apparatus according to claim 1, comprising a second clamping device located on the transport path downstream of the first clamping device for holding a trailing edge region of the printed sheet formed after the printed sheet is cut to terminate the length of the sheet to be wound or taken up onto the take-up roll, wherein the second clamping device is configured to hold or retain the trailing edge region of the sheet against movement along the transport path towards the take-up roll, and wherein the second clamping device is operable to hold or retain the trailing edge region of the printed sheet as the take-up roll rotates to tension the sheet on the roll.

3. The apparatus according to claim 1, the guide device comprising a guide member which is movable between a first position, in which the printed sheet is directed along the transport path towards the take-up roll, and a second position, in which the printed sheet is redirected to the buffer zone, the guide member being configured to rotate or pivot between the first position and the second position.

4. The apparatus according to claim 1, wherein the first clamping device comprises first clamping members, which are movable relative to one another between an open, non-clamping position, for enabling the printed sheet to travel along the transport path towards the take-up roll, and a closed, clamping position for holding or retaining the new leading edge region of the printed sheet.

5. The apparatus according to claim 2, wherein the second clamping device comprises second clamping members, which are movable relative to one another between an open, non-clamping position, for enabling the printed sheet to travel along the transport path towards the take-up roll, and a closed, clamping position for holding or retaining the trailing edge region of the printed sheet.

6. The apparatus according to claim 1, further comprising a cutting device for cutting the printed sheet to terminate a length of the sheet to be wound or taken up onto the take-up roll.

7. The apparatus according to claim 1, further comprising an attachment device for attaching the trailing edge region of the printed sheet onto the take-up roll to complete the winding or taking up of the sheet prior to discharge or removal of the take-up roll.

8. The apparatus according to claim 2, further comprising a control unit for controlling operation of the first clamping device and/or of the second clamping device, and/or for controlling operation of cutting device to cut the sheet.

9. A method of assisting replacement of a take-up roll for winding or taking up a length of a printed sheet with a new take-up roll in a printing system, comprising the steps of:

directing or guiding a printed sheet output from the printing system along a transport path towards the take-up roll for winding or taking up a length of the printed sheet in a take-up position;

cutting the printed sheet to terminate the length of the sheet to be wound or taken up onto the take-up roll in the take-up position, whereby the cutting forms a trailing edge region and a new leading edge region of the printed sheet;

clamping or holding the new leading edge region of the printed sheet against movement along the transport path towards the take-up roll in the take-up position; and redirecting the printed sheet output from the printing system to a buffer zone to accommodate the printed sheet when the take-up roll in the take-up position is being replaced during said clamping or holding of the new leading edge region; and releasing the new leading edge region of the printed sheet from the first clamping device and feeding or drawing the printed sheet out from the buffer zone to be wound onto the new take-up roll after the new take-up roll is mounted in the take-up position to replace the take-up roll.

10. The method according to claim 9, further comprising the step of:

clamping or holding the trailing edge region of the printed sheet against movement on the transport path towards the take-up roll to tension the sheet wound onto or taken up onto the take-up roll.

11. The method according to claim 9, wherein the step of directing or guiding the sheet along the transport path is via a guide member, wherein the step of redirecting the printed sheet to the buffer zone comprises moving, the guide member from a first position, in which the sheet is guided along the transport path towards the take-up roll, to a second position, in which the sheet is redirected to the buffer zone.

12. The method according to claim 9, further comprising the step of: attaching the trailing edge region of the printed sheet onto the take-up roll to complete winding or taking up the printed sheet prior to discharge or removal of the take-up roll.

13. The method according to claim 9, further comprising the steps of:

controlling operation of a first clamping device for clamping or holding the new leading edge region of the printed sheet against movement along the transport path; and/or controlling operation of a guide device for redirecting the printed sheet output from the printing system to the buffer zone during said clamping or holding of the new leading edge region.

14. The method according to claim 9, further comprising the steps of:

controlling operation of a second clamping device for clamping or holding the trailing edge region of the printed sheet against movement along the transport path; and/or controlling operation of an attachment device for attaching the trailing edge region of the printed sheet onto the take-up roll to complete winding or taking up the printed sheet prior to discharge or removal of the take-up roll.

15. The apparatus according to claim 4, wherein the first clamping members are jaw which are movable relative to one another between an open, non-clamping position and a closed, clamping position.

16. The apparatus according to claim 5, wherein the second clamping members are jaw which are movable relative to one another between an open, non-clamping position and a closed, clamping position.

17. The apparatus according to claim 2, further comprising a control unit for controlling operation of the first clamping device and/or of the second clamping device when a cut in the sheet is detected via a sensor, and/or for controlling operation of a cutting device to cut the sheet.

18. The method according to claim 9, wherein the step of directing or guiding the sheet along the transport path is via a guide member, wherein the step of redirecting the printed sheet to the buffer zone comprises rotating or pivoting the guide member from a first position, in which the sheet is guided along the transport path towards the take-up roll, to a second position, in which the sheet is redirected to the buffer zone.

19. A printing system which comprises an apparatus for assisting replacement of a take-up roll for winding or taking up a length of a printed sheet according to claim 1.

* * * * *